US009663198B2

(12) United States Patent
Mair

(10) Patent No.: US 9,663,198 B2
(45) Date of Patent: May 30, 2017

(54) WATERCRAFT FIN PLUG ASSEMBLY

(71) Applicant: Mair Designs LLC, Hanalei, HI (US)

(72) Inventor: Robin Thomas Mair, Hanalei, HI (US)

(73) Assignee: Mair Designs LLC, Hanalei, HI (US)

( * ) Notice: Subject to any disclaimer, the term of this patent is extended or adjusted under 35 U.S.C. 154(b) by 0 days.

(21) Appl. No.: 14/603,589

(22) Filed: Jan. 23, 2015

(65) Prior Publication Data

US 2015/0225045 A1 Aug. 13, 2015

(51) Int. Cl.
*B63B 35/79* (2006.01)

(52) U.S. Cl.
CPC ..... *B63B 35/793* (2013.01); *Y10T 29/49* (2015.01)

(58) Field of Classification Search
CPC ... B63B 35/793; B63B 35/79; B63B 35/7926; Y10T 29/49
USPC ..... 441/74, 79
See application file for complete search history.

(56) References Cited

U.S. PATENT DOCUMENTS

| | | | |
|---|---|---|---|
| 4,379,703 | A | 4/1983 | Mizell |
| 4,904,215 | A | 2/1990 | Sherwood |
| 5,176,553 | A | 1/1993 | Tuttle |
| 5,464,359 | A | 11/1995 | Whitty |
| 5,672,081 | A | 9/1997 | Whitty |
| 6,386,933 | B1 | 5/2002 | Rewald et al. |
| 7,285,031 | B2 | 10/2007 | Mair et al. |
| D635,630 | S | 4/2011 | Durante |
| 8,920,204 | B2 | 12/2014 | Durante |
| 2007/0202760 | A1 | 8/2007 | Caldwell et al. |
| 2010/0173546 | A1 * | 7/2010 | Yeh ..... B63B 35/793 441/74 |
| 2011/0039463 | A1 | 2/2011 | Hort et al. |

FOREIGN PATENT DOCUMENTS

WO WO 2014075138 A1 * 5/2014 ..... B63B 35/793

* cited by examiner

*Primary Examiner* — Anthony Wiest

(74) *Attorney, Agent, or Firm* — Grossman Tucker Perreault & Pfleger PLLC

(57) ABSTRACT

The present disclosure describes a fin plug assembly for removably mounting a watercraft fin on a watercraft. In some embodiments the fin plug assembly includes a fin plug, a fin plug finishing insert and in some instances, a shelf-like support that is configured to house the fin plug assembly. Methods of making, methods of installing, and tools for installing the fin plug assembly in a watercraft are also described.

10 Claims, 4 Drawing Sheets

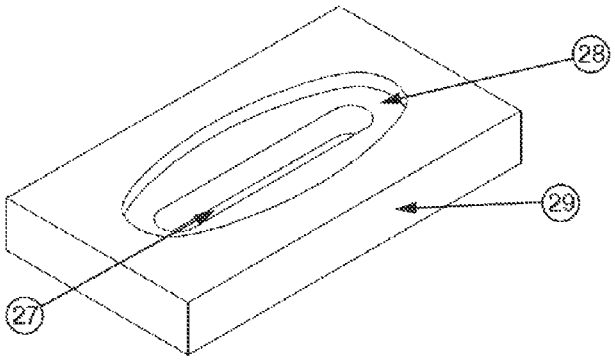
Figure 10
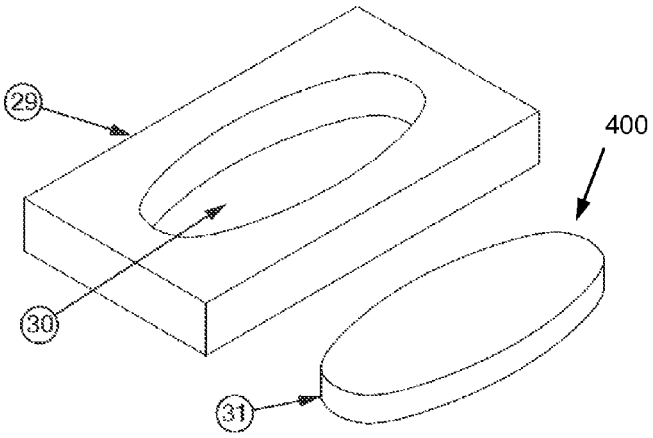
Figure 11
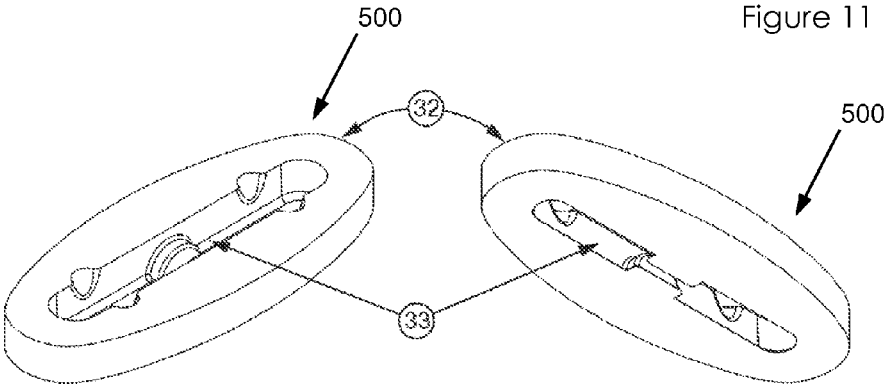
Figure 12
Figure 13

WATERCRAFT FIN PLUG ASSEMBLY

FIELD OF THE INVENTION

This invention relates to watercraft and in particular to assemblies for removably securing fins to the watercraft.

BACKGROUND TO THE INVENTION

A number of watercraft make use of fins that project from the water-facing surface of the craft. On planing craft, such as surfboards, the fins are typically foil-shaped to enhance the directional stability of the craft during high speed planing motion and to facilitate turning.

On watercraft such as surfboards the use of removable fins has become quite commonplace. These fins are removably and interchangeably fitted to the watercraft by means of fin mounting systems embedded in the water-facing surface of the craft, the fin mountings typically having a cavity that is configured to receive the base of the fin. Various securement mechanisms are used to secure the fin base in the mounting system cavity.

In conventional surfboard manufacturing terminology, the fin mounting systems are referred to as fin plugs.

One of the problems encountered with known fin plugs arises from the characteristics of surfboard construction. Surfboards are typically constructed from a relatively low-density foam core enveloped in a glass reinforced polyester resin skin laminated to the core. It will be appreciated that considerable torsional loads are imposed on the fin plug as a result of sideways thrust forces applied to the fin during use of the surfboard. In typical installations, the outer laminate of the surfboard is extended partially over the fin plug, but given the size limitations imposed by the locations where the fin plugs are installed on the surfboard, the laminate contact surface offered by the fin plug is generally insufficient to provide any real support to the fin plug in resisting the torsional loads imposed on the fin plug. The fin plug extends into the foam core of the surfboard and the fin plug is generally attached to the foam core by means of a suitable bonding agent, typically polyester resin which is conventionally used to laminate the surfboard. However, the low-density foam of the core generally does not have sufficient strength to resist the torsional fin plug loads without deformation or weakening of the surrounding foam over time, with consequential reduction in performance of the fin, cracking and shattering of the laminate in the vicinity of the fin plug and eventually delamination of the laminate from the core.

To overcome these problems, fin systems have been proposed that utilise a fin plug with a collar or flange extending about the open end of the fin-receiving cavity. The collar or flange upper surface is intended to stiffen the fin plug against side loads and to provide a bonding surface for the fibreglass laminate covering the fin plug. These fin plugs are typically of injection mouldable plastics, which generally does not bond well to the polyester resin most commonly used to laminate modern watercraft, unless the fin plug is treated, for instance by sanding, to provide some form of mechanical key and even this does little to improve bonding of the plastic to the resin. In addition, it will be appreciated that this introduces a secondary process that increases the cost and complexity of fin system installation.

It is an object of this invention to address these concerns.

The invention will be described with reference to surfboards as examples of watercraft, but it will be appreciated that the invention will find application in any watercraft that makes use of removable, replaceable fins that are mounted in a fin mounting assembly secured within a cavity formed in the water-facing surface of the craft.

Also, the fin mounting assembly is described and referred to as an assembly including a fin plug. In the majority of the examples described herein, the fin plug assembly is a typical surfboard fin plug assembly, but this is not intended to restrict the invention to surfboards and in this regard, the terms "fin plug" and "fin plug assembly" must be given a wider interpretation so as not to restrict the invention to surfboard fin plugs and fin plug assemblies or to the fin plug assembly illustrated in the drawings.

SUMMARY OF THE INVENTION

This invention provides a fin plug assembly for removably mounting a watercraft fin on the watercraft. The fin plug assembly comprises a fin plug, a fin plug finishing insert and, in certain embodiments of the invention, a foam shelf-like support that is configured to house the fin plug assembly. The invention also includes methods and tools for installing the fin plug assembly in a watercraft.

According to the invention, a fin plug assembly is provided for removably mounting a removable watercraft fin on a water-facing surface of a watercraft, the fin plug assembly comprising:

- a fin plug configured for mounting within a cavity formed in the water-facing surface of the watercraft and a finishing insert that is configured to co-operate with the fin plug;
- the fin plug comprising a body formed with a fin receiving housing configured to receive a mounting base of the watercraft fin and a collar that extends about the fin receiving housing, the collar extending outwardly from the fin receiving housing and including a surface relief formation; and
- the finishing insert being shaped complementally to the fin receiving housing and the collar and configured to mate with the operationally water-facing surface of the fin plug, the finishing insert including an upper, operationally water-facing surface that is configured for co-operation with the water-facing surface of the watercraft and an operationally inwardly facing surface that is configured, by means of a surface relief formation shaped complementally to the surface relief formation of the fin plug collar, to co-operate with the collar when, in use, the fin plug is mounted within the cavity formed in the watercraft and the finishing insert is mounted on the fin plug.

The finishing insert is essentially a cover element that is installed into the cavity formed in the watercraft to cover the fin plug and the finishing insert is bonded to the fin plug and the watercraft. In this way, the finishing insert is configured for co-operation with the water-facing surface of the watercraft—the finishing insert is configured to close the cavity formed in the watercraft and to provide, after installation, a water-facing surface that is co-extensive with the water-facing surface of the watercraft.

The finishing insert may be a finished cover plate that, after installation and without much finishing-off work, closes the cavity and provides a finished, water-facing surface co-extensive with the water-facing surface of the watercraft.

Alternatively, the finishing insert may be unfinished and configured for installation into the cavity after which finishing-off work needs to be done to conform the installed finishing insert to the water-facing surface of the watercraft.

This is a form of the invention that finds particular application with foam-cored watercraft such as surfboards and in this form of the invention the finishing insert is preferably made of a foam similar to the foam core, possibly with a higher density. This form of the finishing insert will typically be installed into the cavity after the fin plug has been installed but before the surface laminate is applied to the foam core, a process that will require the finishing insert to be conformed to the foam core shape using conventional foam shaping tools.

The relief formation or formations on the fin plug collar and finishing insert may be any device or design that modifies the complemental, co-operating surface areas of the collar and finishing insert to something other than a flat plane surface, including mating projections and depressions or any other mechanical key devices or formations.

In the preferred form of the invention, the fin plug relief formation is constituted by concave configuration of the collar, the collar extending about and outwardly from the fin receiving housing and terminating in an enlarged perimetral rim that defines a central depression extending between the rim and the fin receiving housing.

The perimetral rim gives the collar of the fin plug a shape that is concave in cross-section, which renders it substantially more resistant to torsional stress than the simple flat collars or flanges of conventional fin plugs.

The perimetral rim may be configured to extend operationally outwardly from the collar surface to define an operationally outwardly facing concavity. However, other configurations would work equally well, including an operationally inwardly facing rim or a rim that extends in both directions—inwardly and outwardly facing from either surface of the collar.

In this regard, the terms "out", "outwardly", "outwardly facing" and even "up" or "upwardly" refer to any orientation of a surface or thing that, like the water-facing surface of the watercraft, faces operationally outwardly towards the outside or the water (when the watercraft is in use). Conversely, the terms "in", "inwardly", "inwardly facing" and "down" or "downwardly" refer to the opposite, being any orientation of a surface or thing that faces inwardly into the cavity formed in the watercraft.

Besides the inherent strength of a concave collar shape, the raised perimetral rim constitutes a torsion band that extends about the perimeter of the fin plug. The torsion band serves to resist torsional deformation of the fin plug in use. The resistance to torsional stress and the general rigidity of the fin plug assembly is further enhanced by the fin plug finishing insert which, when bonded to the fin plug, provides further torsional resistance.

The collar, in the preferred form of the invention, is pierced by a plurality of apertures formed in the collar material, the collar material remaining between the apertures constituting interstitial webs.

Besides reducing the mass of the fin plug, which is in itself desirable, the interstitial webs and the apertures in the collar provide additional relief formations and mechanical key for subsequent bonding of the fin plug to the watercraft.

To provide even further surface relief, the surfaces of the interstitial webs may be grooved and in a preferred embodiment of this form of the invention, the web edges are rebated.

The finishing insert is preferably configured to mate with the concavity defined in the collar by the perimetral rim, the finishing insert being configured to be inserted and housed within the concavity in the collar.

In these embodiments of the invention, the finishing insert may be formed with surface protrusions shaped complementally to the apertures and webs formed in the fin plug collar.

Where the fin plug collar is pierced, the protrusions formed on the mating surface of the finishing insert may conveniently be configured to match the apertures in the fin plug collar exactly and to protrude into the apertures upon insertion of the finishing insert into the fin plug.

The fin plug assembly is preferably configured for use with a watercraft constructed of an inner core surfaced with a sheet material overlay laminated to the core by means of a bonding agent, the fin plug being configured for mounting under the surface laminate within a cavity pre-formed in the watercraft core, the finishing insert being configured for mounting between the surface laminate and the fin plug and the finishing insert and fin plug being configured for bonding with the bonding agent that is used to bond the surface laminate to the core.

For such watercraft, the finishing insert may conveniently be of a material more compatible with the laminate bonding agent than the material of the fin plug. An example of such a more compatible material is a foam material similar to the foam material of the watercraft core, which is substantially more compatible with the laminate bonding agent than the conventional plastics materials from which the fin plug is manufactured.

When the fin plug assembly is installed within the cavity in the watercraft and the finishing insert is bonded to the outwardly facing surface of the fin plug, the finishing insert becomes (or is finished off to become) co-extensive with the foam core. In the lamination process, the part of the fin plug assembly exposed to the laminate and bonding agent is the outwardly facing surface of the finishing insert. Being made of a more compatible material, the surface laminate will form a substantially stronger bond with the surface of the finishing insert than it will with the plastics material surface of a conventional fin plug.

In certain embodiments of the invention, the fin plug assembly may include an initially discrete, complementally shaped shelf-like support configured to house the fin plug assembly within the cavity pre-formed in the watercraft core, the cavity and shelf-like support being complementally shaped.

The shelf-like support may conveniently also be of a material more compatible with the laminate bonding agent than the material of the fin plug and as indicated above, the complemental shelf-like support may be made from a foam material similar to the foam material of the watercraft core and preferably from a high density foam material.

The invention includes a shelf-like support configured for use within the fin plug assembly of the invention, as described above, the shelf-like support being formed, internally, with a central aperture configured to accept the fin receiving housing and, externally, to fit snugly within a mounting cavity to be formed within the watercraft core when, in use, the shelf-like support is installed, the shelf-like support being dimensioned to form a shelf to support the fin plug collar at the appropriate level relatively to the surface of the watercraft core.

To accommodate and retain the fin plug securely, the shelf-like support might, depending on the complexity of the fin plug shape, require a central aperture with a relatively complex shape in order to complement the shape of the fin plug. In contrast, the external shape of the shelf-like support can be relatively simple to facilitate installation in the core of the watercraft, where a receiving cavity of relatively simple shape can be formed to accommodate the relatively simple external shape of the shelf-like support.

The invention also includes a fin plug finishing insert configured for use within the fin plug assembly of the invention, as described above.

The finishing insert, in embodiments of the invention, is preferably configured for use with a watercraft constructed of an inner core surfaced with a sheet material overlay laminated to the core by means of a bonding agent, the fin plug being configured for mounting under the surface laminate within a cavity pre-formed in the watercraft core, the finishing insert being configured for mounting between the surface laminate and the fin plug and the finishing insert and fin plug being configured for bonding with the bonding agent that is used to bond the surface laminate to the core, the finishing insert being made of a material similar to the watercraft core material.

The invention includes methods of preparing a watercraft for the installation, in the watercraft, of the fin plug assembly of the invention, as well as cavity forming templates for this purpose, the templates essentially being router jigs or templates.

BRIEF DESCRIPTION OF THE DRAWINGS

The invention will be further described with reference to the accompanying drawings in which:

FIG. 10 is an isometric view of an installation cavity formed in the foam body of a watercraft by means of a router using the router jigs of FIGS. 7, 8 and 9;

FIG. 11 is an isometric view of an alternative installation cavity and a foam shelf-like support for use therewith;

FIG. 12 is an isometric view of a foam shelf-like support configured for location in an installation cavity similar to the FIG. 11 cavity;

FIG. 13 is an isometric view from below on the foam shelf-like support of FIG. 12;

DESCRIPTION OF EMBODIMENTS OF THE INVENTION

Figure 1:
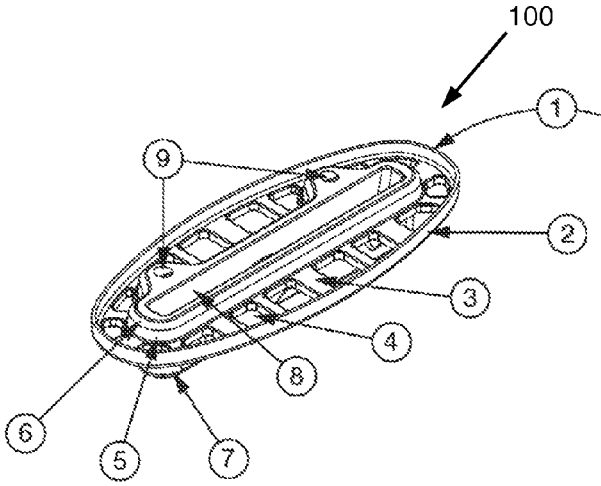
FIG. 1 is an isometric view from above on a fin plug forming part of the fin plug assembly of the invention.

The fin plug assembly 300 of the invention comprises a number of parts that together constitute a fin mounting device similar to so-called collared or flange-type fin plugs for removably mounting a removable watercraft fin (not shown) on a watercraft. The parts include a fin plug 100 and foam filler or finishing insert 200 that is configured to fit within the fin plug 100. The entire assembly 300 is intended for installation, with or without a foam shelf-like support 31, 32 in a complementally shaped cavity formed in the foam core of a watercraft, such as a surfboard (not shown in full in the drawings).

The fin plug 100 is integrally moulded from injection moulded plastics with a flange-like perimeter or collar 1 extending about a fin receiving housing or fin box extending about the open end of a fin box constituted by a fin slot 8 and fin box base 7.

The load beam collar 1 has a rim or lip 2 extending about the perimeter of the load beam collar 1. The raised perimetral rim 2 defines a central depression within the collar 1 extending between the perimetral rim 2 and the fin slot 8. The rim 2 provides torsional stability to the load beam collar 1.

The collar 1 is pierced to define a series of structural webs 3 pierced by truss apertures 4, the webs 3 maintaining the structural integrity of the load beam collar 1 while the truss apertures 4 are intended to reduce weight and dissipate torsional loads from the fin box into the load beam collar 1.

A dam plinth 5 extends about a raised slot dam 6 that defines the open end of the fin slot 8 and the wall of which extends downwardly into the fin box base 7 that completes the fin slot 8. In use the base of the watercraft fin is accommodated within the fin slot 8 and fin box base 7, which is dimensioned to allow forward and rearward adjustment of the fin. Grub screws 9 are used to secure and lock the fin base into the fin slot 8.

Figure 2:
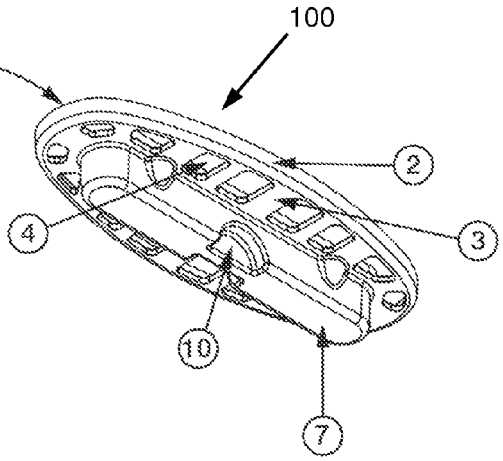
FIG. 2 is an isometric view from below on the fin plug of FIG. 1.
Figure 3:
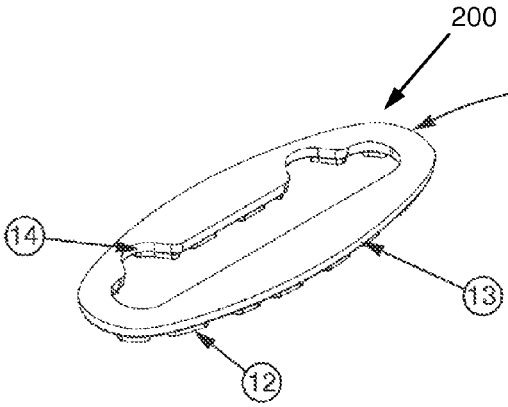
FIG. 3 is an isometric view from above of a finishing insert forming part of the fin plug assembly of the invention.
Figure 4:
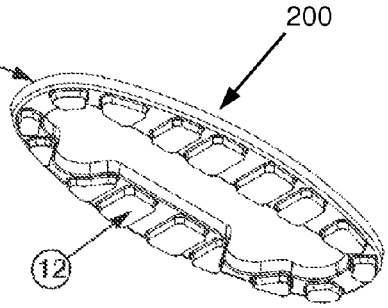
FIG. 4 is an isometric view from below of the finishing insert of FIG. 3.

The fin box base 7 (as can be seen from FIGS. 2 and 6) is formed with a central narrowed section that defines a slot bridge 10.

The fin plug assembly 300 includes a load beam finishing insert 200 that is configured to be inserted and to fit complementally within the load beam collar 1, the finishing insert 200 being shaped complementally to the collar 1 and the depression formed by the perimetral rim 2. The finishing insert 200 is formed with an internal opening that is configured partially to expose the dam plinth 5 and to fully expose the slot dam 6, the fin slot 8 and the grub screws 9. The outer perimeter 13 of the load beam finishing insert 200 is shaped to conform closely to the shape of the load beam collar 1 and the collar rim 2. The inner perimeter 14 of the finishing insert 200 is shaped to confirm closely to the shape of the dam plinth 5, which is dimensioned to extend above the finishing insert 200 when the finishing insert is installed in the collar 1, the external surface of the finishing insert 100 being dimensioned to lie flush with the upper surface of the perimetral rim 2 after installation of the finishing insert 200 in the collar 1. The under surface of the finishing insert 200 is formed with truss protrusions 12 that are shaped and configured to fit snugly within the truss apertures 4 in the load beam collar 1.

Figure 5:
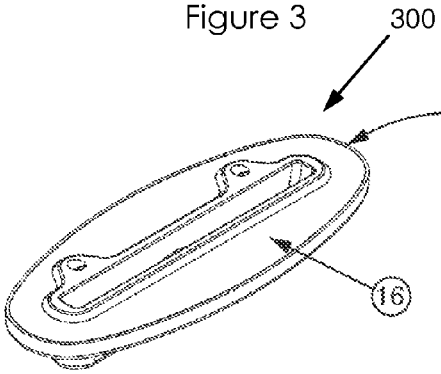
FIG. 5 is an isometric view from above of a fin plug assembly constituted by the fin plug of FIGS. 1 and 2 assembled with the finishing insert of FIGS. 3 and 4.
Figure 6:
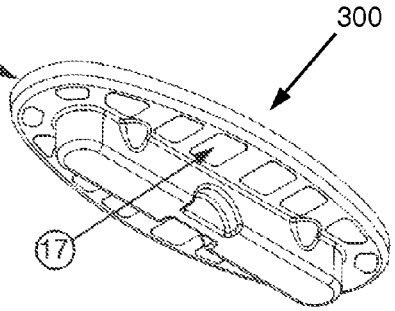
FIG. 6 is an isometric view from below of the fin plug assembly of FIG. 5.

During assembly of the fin plug assembly 300, the load beam finishing insert 200 is fitted within the load beam collar 1 to yield the fin plug assembly 300 (as illustrated in FIGS. 5 and 6, in which the numeral 16 designates the load beam finishing insert 200 installed into the fin plug 100 and the numeral 17 designates the underside of the truss protrusions 12 of the load beam finishing insert 200 extending into the load beam truss apertures 4).

The fin plug assembly 300 illustrated in the drawings is adapted for use with watercraft constructed of an inner core surfaced with a sheet material overlay laminated to the core by means of a suitable adhesive, such as surfboards, which typically are constructed with a low density foam core surfaced with a polyester resin impregnated fibreglass sheet material laminate. The resin is used as an adhesive that adheres the sheet material laminate to the foam core. The fin plug assembly 300, like a conventional fin plug, is adapted for mounting under the surface laminate with the fin plug 100 mounted within a pre-formed cavity in the foam. The laminating resin is used as an adhesive to adhere to the fin plug assembly 300 in the cavity in the foam core and to the overlying laminate.

Fin plugs, like the fin plug 100 of the invention, are typically made from injection moulded plastics, which does not bond exceptionally well to polyester resin. The finishing insert 200 of the invention, on the other hand, can be made of a material that is substantially more compatible with the laminate adhesive (in this case polyester resin). To this end, the finishing insert 200 may be made from a foam material similar to the foam material of the surfboard core, which is substantially more compatible with polyester resin than the plastics material of the fin plug 100. When the fin plug assembly 300, with the finishing insert 200 bonded to the fin plug 100, is installed in the watercraft, the surface laminate will form a substantially stronger bond with the more compatible surface of the finishing insert 200 than it will with the plastics material surface of the fin plug 100. With proper design, it is possible to ensure that very little of the fin plug 100 (preferably the upper surface of the perimetral rim or less) is exposed to the resin.

The fin plug assembly 300 of the invention addresses both the bonding and strength concerns outlined above with the use of the fin plug 100 and the complemental, light weight finishing insert 200. The perimetral rim 2 of the collar 1, in effect, converts the conventionally flat flange or collar of a typical fin plug into a non-planar load beam. The use of a non-planar structure provides strength without requiring the same mass as a conventional fin plug flange. In the fin plug 100 of the invention, the mass of the fin plug 100 is further reduced by the formation of truss apertures 4 in the collar to define webs 3 that transfer load to the perimetral rim 2, thereby reducing mass without sacrificing rigidity or strength.

The use of a separate load beam finishing insert 200 provides the opportunity for improving the mechanical strength of the fin plug assembly 300 by virtue of the fact that a wide choice of finishing insert materials is available. The finishing insert 200 will most preferably be moulded from polyurethane foam, which will make it compatible with all resin system and the core foam used most commonly in the construction of watercraft such as surf boards. The finishing insert 200 fills the entire interior of the load beam collar 1 and extends from the rim 2 of the load beam collar 1 to the dam plinth 5 at the centre of the load beam collar 1.

The use of the finishing insert 200 also permits the use of materials other than foam, either for decorative or structural purposes. For instance the finishing insert 200 could be of wood such as balsa wood or of other types of foam such as expanded polystyrene. With the use of an overlay laminated to the upper surface of the finishing insert 200, the mechanical bonding capacity and structural strength of the finishing insert 200 can also be improved. Examples of such overlays include carbon fibre, fibreglass wood veneers or the like. The material of the finishing insert will nevertheless at all times be selected for superior bonding capabilities to the resins and laminates used in the construction of the watercraft.

In the preferred form of the invention, the finishing insert 200 is preferably bonded into the load beam collar 1 at the factory. It will be appreciated, however, that the use of a separate finishing insert 200 provides an opportunity for the finishing insert 200 to be provided separately to a customer, thereby allowing the customer to personalize the watercraft with the use of an finishing insert or overlaid finishing insert different from the standard finishing insert The finishing insert 200 also maximizes bonding capacity by providing a large upper surface area. This combines with a substantial bonding surface on the undersurface of the finishing insert, constituted by the truss protrusions 12 extending through the load beam truss apertures 4 once the finishing insert 200 is installed in the load beam collar 1. This provides better mechanical key and bonding to the watercraft foam core on the underside of the fin plug assembly 300.

The structural integrity of the load beam collar 1 is improved by the use of the slot bridge 10 that serves, essentially, to tie the side walls of the fin box base 7 together, thereby reducing torsional flexibility of the fin box base 7 and assisting in the dissipation of side loads.

A fin (not shown) placed into the fin slot 8 is held in place by two grub screws placed either to one side of the slot 8 (as illustrated in the drawings) or one on either side of the slot 8 (as would be the case for a centre fin). The grub screws 9 pass through the fin plug 100 at an angle to exert both lateral and downward forces on the fin base, firmly locking the fin in the fin box base 7. The fin slot 8 is dimensioned to be slightly longer than the fin base, thereby allowing for forward and backward adjustment of the fin.

Figure 7:
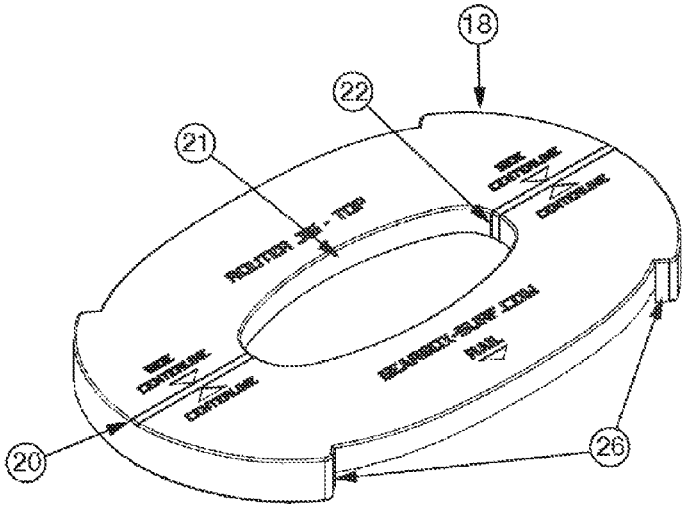
FIG. 7 is an isometric view of uppermost jig of a series of routing jigs configured for use in the installation of the assembly of FIGS. 5 and 6 into a surfcraft.
Figure 8:
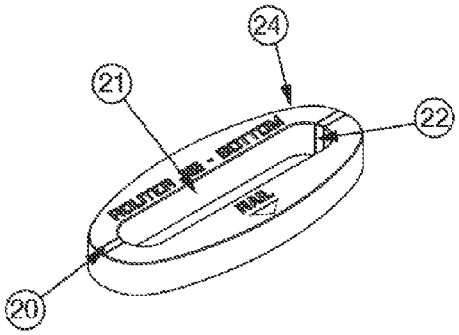
FIG. 8 is an isometric view of a bottom routing jig forming part of the series of routing jigs.
Figure 9:
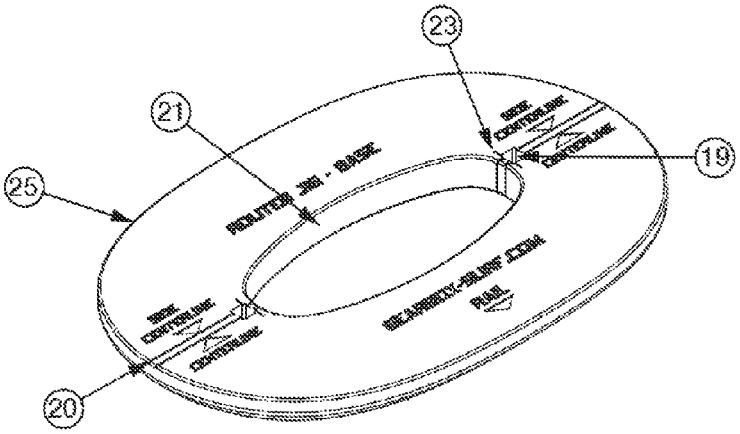
FIG. 9 is an isometric view of a base routing jig forming part of the series of jigs.

FIGS. 7 to 9 illustrate a routing system consisting of a series of routing jigs by means of which the watercraft shaper may use a conventional router to form appropriately shaped cavities within the watercraft foam to accommodate the fin plug assembly 300.

If the fin plug assembly 300 is to be installed directly into the foam core of a watercraft, a two-step routing process is followed that produces a stepped cavity in the foam core of the watercraft to accommodate the fin plug assembly 300. The cavity includes a central bottom cavity 27 that is dimensioned to accommodate the fin box base 7. A shelf cavity 28 is then formed about the perimeter of the bottom cavity 27, the shelf cavity 28 being dimensioned to accommodate and support the load beam collar 1 of the fin plug 100.

To produce the cavity of FIG. 10, a base jig 25 (FIG. 9) is positioned on the watercraft foam core 29. Once positioned, the base jig 25 is not moved until after routing has been completed.

A bottom jig (FIG. 8) is then located within the inner perimeter 21 of the base jig 25 and the inner perimeter 21 of the bottom jig 24 is used to guide the router to produce the bottom cavity 27 in the watercraft foam 29. This is the deepest of the cavities to be routed. The bottom jig 24 is then removed and the top jig 18 is placed on the base jig 25. This serves to raise the router support surface to correct height and no depth adjustment of the router bit is required to rout the shelf cavity 28. The inner perimeter 21 of the top jig 18 is then used to guide the router bit to rout the shelf cavity 28. The top jig 18 is provided with a set of end locators 26 that lock on to the ends of the base jig 25 to secure the top jig 18 securely on the base jig 25.

All the jigs have shaper's marks on them to help the shaper locate and position the jigs correctly, including a shaper's mark window 19, centerline markings 20, vertical centerlines 22 and a cross hatch 23. The primary location of the jigs 18, 24, 25 is provided by the base jig 25 and the shaper's marks referred to above are primarily used to ensure that nothing has moved during the routing process.

FIG. 11 illustrates a second installation method that makes use of a single cavity 30 in the watercraft foam core 29 as opposed to the multi-cavity illustrated in FIG. 10. This method uses the base jig 25 to rout a single cavity 30 (FIG. 11). A separate foam SHELF-LIKE SUPPORT 31, preferably of high density foam, is located within the routed single cavity 30 and the bottom jig 24, placed within the base jig 25, is then used to rout a cavity similar to the bottom cavity 27 in the foam shelf-like support 31. The perimeter of the foam shelf-like support 31 is pre-cut to the correct shape of the routed single cavity 30 and the thickness thereof is dimensioned automatically to form a shelf-like supporting shelf, similar to the shelf cavity 28 of the multi-cavity illustrated in FIG. 10 thereby to provide a supporting shelf for the fin plug assembly 300.

The FIG. 11 installation method provides a simplified process with fewer steps compared to the FIG. 10 method. It also has the advantage of providing an opportunity to use a high density foam for the foam shelf-like support 31 for installations where the foam core 29 of the watercraft is of insufficient strength to provide adequate support for the fin plug assembly 300.

FIG. 11 illustrates the initial routed single cavity 30 before insertion of the foam shelf-like support 31, which is illustrated before formation of a bottom cavity therein.

FIGS. 12 and 13 illustrate yet a further foam shelf-like support or foam shelf-like support 32 that is intended to take the place of the foam shelf-like support 31 illustrated in FIG. 11.

In this embodiment of the invention, the foam shelf-like support 32 is pre-moulded, preferably in a high density foam, the shelf-like support 32 being shaped complementally to the underside of the fin plug assembly 300 and to receive and shelf-like support the fin plug assembly 300. In particular, the shelf-like support 32 is shaped to conform to the fin box base 7 and slot bridge 10.

To install the foam shelf-like support 32, a single cavity similar to the single cavity 32 of FIG. 11 is routed in the watercraft foam core and the foam shelf-like support 32 is installed in the single cavity 30 instead of the foam shelf-like support 31, with no need for additional routing.

In all the installation instances described above, the appropriate cavity is routed into the foam core 29 of the watercraft. The routed cavity is then filled with resin.

Using the first installation method (FIG. 10) the assembled fin plug assembly 300 is installed directly into the cavity, with the fin box base 7 being housed within the bottom cavity 27 and the load beam collar 1 of the fin plug 100 supported on the shelf cavity 28.

Using the second method illustrated with reference to FIG. 11, the single cavity 30 is filled with resin and the foam shelf-like support 31 (with the bottom cavity routed therein) is then pressed into the cavity 30. The support shelf and bottom cavity previously formed in the foam shelf-like support 31 are then filled with resin and the fin plug assembly 300 is pressed into the foam support cavities until the fin box base 7 is fully installed within the bottom cavity and the flange of the load beam housing is properly supported on the shelf cavity defined by the upper surface of the foam shelf-like support 31.

Using the pre-moulded foam shelf-like support 32, a similar installation method is followed. The cavity 30 is filled with resin, the foam shelf-like support 32 is pressed into the cavity 30 such that the upper surface of the foam shelf-like support 32 provides a shelf cavity similar to the shelf cavity 28 illustrated in FIG. 10. If necessary, additional resin is poured into the cavity and the fin plug assembly 300 is pressed into the foam shelf-like support 32. In similar fashion to that described above, the fin box base 7 is pressed into the foam support cavity 33 to the extent that the shaped underside of the base 7 fully engages with the complemental shapes in the foam support cavity 33 and the underside of the collar 1 of the fin plug 100 is fully engaged with the shelf cavity defined by the upper surface of the foam shelf-like support 32.

Fibreglass lamination can now proceed over the top of the assembled, installed fin plug assembly 300.

The load beam collar 1 of this invention provides a torsionally stiff load beam that stiffens the entire structure against the torsional loads imposed by surfboard fins in use. This is a similar role to that performed by the flanges of existing flange-type fin plugs. Unlike conventional fin plugs, however, the fin plug assembly 300 of the invention includes a load beam collar 1 that enhances the torsional stability of the fin plug assembly 300 without adding significantly to the mass of the fin plug assembly 300. Due to the fact that the rim 2 extends upwardly about the perimeter of the load beam collar 1, any twisting (torsional stress) of the flange part of the load beam collar 1 will serve to place the rim 2 under tension, which the rim will resist, thereby increasing the torsional stability of the load beam collar 1.

The finishing insert 200 co-operates structurally with the load beam collar 1 when the finishing insert is bonded into the fin plug 100. For this reason there is no need for the fin plug assembly 300 to be as heavily constructed as would typically be the case with flange-type fin plugs, thereby allowing reduced mass and lightweight construction. The collar truss apertures 4 serve further to reduce the mass of the structure whilst at the same time providing a locating device for the load beam finishing insert truss protrusions 12, thereby enhancing structural co-operation between the finishing insert 200 and the load beam collar 1 whilst at the same time, providing better mechanical key for resin bonding to the undersurface of the fin plug assembly 300.

The load beam finishing insert 200 serves two primary purposes within the fin plug assembly 300—improved mechanical bonding and structural strength.

The primary role of the finishing insert 200 is to fill out the "cup" created by the collar rim 2, thereby providing a large surface for mechanical bonding for the overlying laminate of the watercraft. As a result, the primary bonding surface presented to the overlying laminate is one that is better able to provide a strong mechanical bond as opposed to that presented by conventional injection moulded plastics fin plugs. In this way, the finishing insert 200 provides a large, flat expanse of superior mechanical bonding surface, with very little plastic (only the upper surface of the rim 2) exposed to the overlying laminate, thereby vastly improving mechanical bonding.

In addition, (the truss protrusions 12) on the underside of the finishing insert 200 protrude through the load beam 1 through the load beam truss apertures 4, thereby improving the overall mechanical bonding surface presented to the watercraft foam core 29.

Cosmetically, the use of the finishing insert reduces the amount of exposed plastic (which is normally visible through the overlying laminate) which allows the fin plug assembly 300 to blend more fully into the bottom of the watercraft. As described above, the finishing insert can, in addition, be used as a decorative feature. Most commonly, a polyurethane foam would be used to create the finishing insert 200, but there are other materials that could be utilised for different applications. For example, in a wood surfboard, the finishing insert could be of matching wood.

The finishing insert 200 illustrated in the drawings is of substantially the same perimetral shape as the load beam collar 1, with the inner boundary of the upper surface of the finishing insert 200 being constituted by the dam plinth 5 and the outer boundary of the finishing insert 200 being constituted by the upper edge of the collar rim 2. This is not a necessary requirement however, since the finishing insert 200 and the rim 2 could be dimensioned for the rim 2 not to extend through the upper surface of the finishing insert, the edges of which could possibly extend beyond the perimeter of the load beam collar 1. This might require additional routing in the foam core 29 of the watercraft. Once this is done, however, the designers' ingenuity is the only limitation to the decorative possibilities presented by the finishing insert 200, with materials such as wood, carbon fibre and decorative decals being but some examples.

In order for the slot dam 6 to "float" above the upper surface of the load beam finishing insert 200, it is formed within a raised plinth 5 that elevates and supports the dam 6. In co-operation with the collar rim 2, the dam plinth 5 serves, effectively, as an I-beam.

All lamination systems in which the laminate extends over the top of the system make use of a raised dam that will eventually be sanded down to expose the fin slot 8 and grub screws 9. The dam typically has a 45° slope around the entire outer perimeter to ensure that the laminate lays down flat over the collar 1.

The fin slot 8 and grub screws 9 are conventional, but the slot bridge 10 is not. The lateral forces generated by a watercraft fin in use tend to force the fin slot 8 and the fin box base 7 to spread open. The primary role of the collar 1 is to minimize opening or spreading of the fin slot 8 under such torsional stresses. This function is enhanced by the slot bridge 10 which serves to tie the two sides of the fin slot 8 and the fin box base 7 together in the centre of the fin box base 7. The bridge 10 is not extended to the top of the fin box base 7 and slot 8, thereby allowing the use of a full length fin base which allows the fin loads to be spread over the greatest slot area.

Like the finishing insert which need not be limited to the shape illustrated in the drawings, the single cavity foam shelf-like support 31 and foam shelf-like support 32 illustrated in FIGS. 11, 12 and 13 need not necessarily follow the exact perimetral shape of the fin plug assembly 300 and collar 1 in particular.

Figure 14:
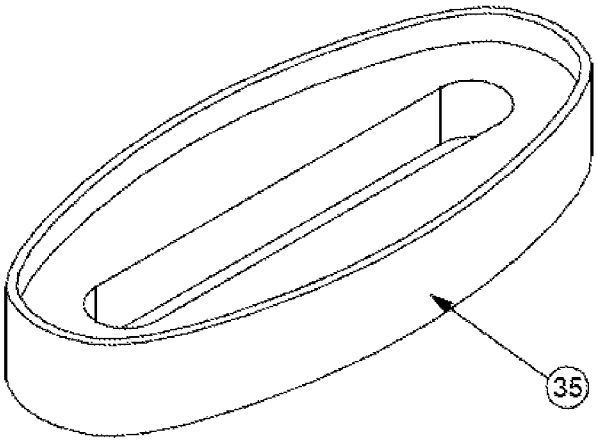
FIG. 14 is an isometric view of yet a further foam shelf-like support configured for location in an installation cavity similar to the FIG. 11 cavity.

Depending on the application, it might be appropriate to install a foam shelf-like support that is larger and possibly differently shaped to the perimetral outline of the collar 1. Examples of such foam shelf-like supports 35, 34 are illustrated in FIGS. 14 and 15.

Figure 15:
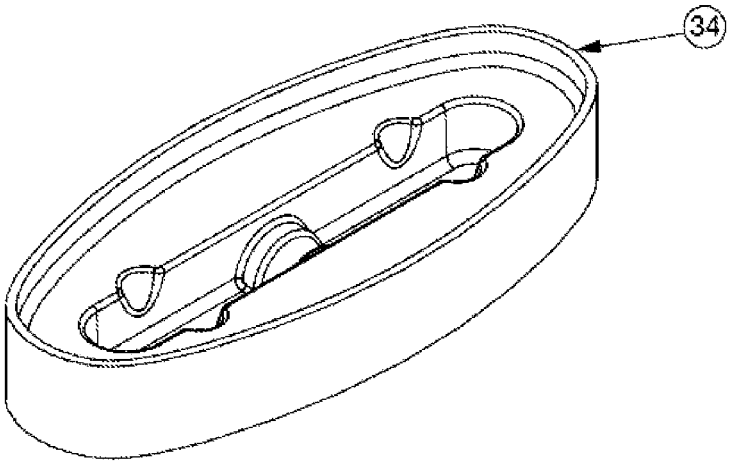
FIG. 15 is an isometric view of yet a further alternative foam shelf-like support that is similar to the foam shelf-like support of FIGS. 12 and 13.

The foam shelf-like support 34 illustrated in FIG. 15 is substantially equivalent to the foam shelf-like support 32 of FIGS. 12 and 13.

The foam shelf-like support 34 requires a cavity to be formed in the watercraft foam core 29 using the base jig 25 to rout no more than a single cavity, similar to the cavity 30 of FIG. 11. Like the foam shelf-like support 32, the shelf-like support 34 is pre-moulded, preferably in a high density foam, the shelf-like support 34 being shaped complementally to the underside of the fin plug assembly 300 and to receive and shelf-like support the fin plug assembly 300. The shelf-like support 34 is also shaped to conform to the fin box base 7 and slot bridge 10.

To install the foam shelf-like support 34, a single cavity similar to the single cavity 30 of FIG. 11 is routed in the watercraft foam core 29 and the foam shelf-like support 34 is installed in the single cavity 30 with no need for additional routing. The foam shelf-like support 34 is located and installed within the routed single cavity 30 using resin as described above.

The shelf-like support 34 is pre-formed with a supporting shelf similar to the shelf cavity 28 of the multi-cavity illustrated in FIG. 10 thereby to provide a supporting shelf for the fin plug assembly 300.

The perimeter of the foam shelf-like support 34 is larger and dimensioned to extend beyond the perimetral outline of the rim 2 extending about the perimeter of the load beam collar 1, with the perimeter of the foam shelf-like support 34 defining a foam collar extending about the fin plug assembly 300, once installed in the shelf-like support 34.

To accommodate the fin plug assembly 300, the cavity in the foam finishing insert 34 is pre-formed and configured for the fin plug assembly 300 to fit snugly within the cavity, with the underside of the fin box base 7 housed within the bottom cavity formed in the shelf-like support 34 and the underside of the load beam collar 1 of the fin plug 100 supported on the shelf pre-formed in the shelf-like support 34.

When fully installed in the foam shelf-like support 34, the upper, external surface of the foam shelf-like support 34 is dimensioned to be flush with the upper surface of the perimetral rim 2 and the finishing insert 200 installed therein.

The foam shelf-like support 35 of FIG. 14 is similar in appearance and use to the foam shelf-like support 29 of FIG. 11.

Like the foam shelf-like support 34, the shelf-like support 35 requires a cavity to be formed in the watercraft foam core 29 using the base jig 25 to rout no more than a single cavity, similar to the cavity 30 of FIG. 11.

The shelf-like support 35 is pre-moulded, preferably in a high density foam, the shelf-like support 35 being shaped complementally to the underside of the fin plug assembly 300 and to receive and support the fin plug assembly 300. The bottom cavity in the shelf-like support 35 is simple and not shaped to conform to the fin box base 7 and slot bridge 10.

The foam shelf-like support 35 is installed similarly to the shelf-like supports described above.

Like the shelf-like support 34, the perimeter of the foam shelf-like support 35 is larger and dimensioned to extend beyond the perimetral outline of the rim 2 extending about the perimeter of the load beam collar 1, with the perimeter of the foam shelf-like support 35 defining a foam collar extending about the fin plug assembly 300, once installed in the shelf-like support 35.

In both cases (34, FIG. 15; 35, FIG. 14) the foam shelf-like supports have a depression or cavity formed in the upper surface that will accept and locate the entire fin plug assembly 300 (fin plug 100 and finishing insert 200) in the depression or cavity formed in the upper surface of the foam shelf-like support 34, 35.

The fin plug 100 is located within this depression with the fin plug finishing insert 200 flush with the upper surface of the foam shelf-like support 34, 35, which is dimensioned to extend, like a foam collar, beyond the fin plug perimeter or collar 1.

What is claimed is:

1. A fin plug assembly for removably mounting a removable watercraft fin on a water-facing surface of a watercraft, the fin plug assembly comprising:

a fin plug; and a finishing insert;

wherein:

the fin plug is configured for mounting within a cavity formed in the water-facing surface of the watercraft and comprises a body formed with a fin receiving housing configured to house a mounting base of the watercraft fin and a collar that extends about the fin receiving housing, the collar extending outwardly from the fin receiving housing and including a surface relief formation;

the finishing insert is configured to co-operate with the fin plug;

the finishing insert is shaped so as to be complementary to the fin receiving housing and the collar;

the finishing insert is configured to mate with an operationally water-facing surface of the fin plug;

the finishing insert includes an upper, operationally water-facing surface that is configured for co-operation with the water-facing surface of the watercraft and an operationally inwardly facing surface that has a surface relief formation shaped complementally to the surface relief formation of the fin plug collar so as to co-operate with the collar when, in use, the fin plug is mounted within the cavity formed in the watercraft and the finishing insert is mounted on the fin plug; and the fin plug relief formation includes a concave configuration of the collar, the collar extending about and outwardly from the fin receiving housing and including a perimetral rim that defines a central depression extending between the rim and the fin receiving housing.

2. The fin plug assembly of claim 1 in which the insert is configured to be inserted and housed within and to mate with the concave configuration of the collar.

3. The fin plug assembly of claim 1, wherein the collar comprises a collar material, and a plurality of apertures are formed in the collar material.

4. The fin plug assembly of claim 3, wherein the finishing insert comprises surface protrusions that are shaped complementary to the apertures.

5. The fin plug assembly of claim 1, further comprising a shelf-like support configured to house the fin plug assembly within the cavity pre-formed in the watercraft core, wherein the cavity and shelf-like support are complementary shaped.

6. The fin plug assembly of claim 5, wherein:

the shelf-like support is formed, internally, with a central aperture configured to accept the fin receiving housing and, externally, to fit within the cavity pre-formed within the watercraft core; and the shelf-like support is dimensioned such that when it is installed in the cavity pre-formed within the watercraft core, it forms a shelf to support the fin plug collar at an appropriate level relatively to the surface of the watercraft core.

7. The fin plug assembly of claim 5, wherein the shelf-like support is shaped, internally, to conform to and accommodate the underside of the fin plug assembly in a complementary fashion.

8. A fin plug assembly for removably mounting a removable watercraft fin on a water-facing surface of a watercraft, the fin plug assembly comprising:

a fin plug;

a finishing insert; and a shelf-like support configured to house the fin plug assembly within a cavity pre-formed in the watercraft core, wherein the cavity and shelf-like support are complementary shaped;

wherein:

the fin plug is configured for mounting within the cavity formed in the water-facing surface of the watercraft and comprises a body formed with a fin receiving housing configured to house a mounting base of the watercraft fin and a collar that extends about the fin receiving housing, the collar extending outwardly from the fin receiving housing and including a surface relief formation;

the finishing insert is configured to co-operate with the fin plug;

the finishing insert is shaped so as to be complementary to the fin receiving housing and the collar;

the finishing insert is configured to mate with an operationally water-facing surface of the fin plug;

the finishing insert includes an upper, operationally water-facing surface that is configured for co-operation with the water-facing surface of the watercraft and an operationally inwardly facing surface that has a surface relief formation shaped complementally to the surface relief formation of the fin plug collar so as to co-operate with the collar when, in use, the fin plug is mounted within the cavity formed in the watercraft and the finishing insert is mounted on the fin plug.

9. The fin plug assembly of claim 8, wherein:

the shelf-like support is formed, internally, with a central aperture configured to accept the fin receiving housing and, externally, to fit within the cavity pre-formed within the watercraft core; and the shelf-like support is dimensioned such that when it is installed in the cavity pre-formed within the watercraft core, it forms a shelf to support the fin plug collar at an appropriate level relatively to the surface of the watercraft core.

10. The fin plug assembly of claim 9, wherein the shelf-like support is shaped, internally, to conform to and accommodate the underside of the fin plug assembly in a complementary fashion.

* * * * *